United States Patent [19]

Kanou

[11] Patent Number: 4,981,384

[45] Date of Patent: Jan. 1, 1991

[54] APPLICATOR

[75] Inventor: Kinya Kanou, Sakai, Japan

[73] Assignee: Taiyo, Ltd., Osaka, Japan

[21] Appl. No.: 333,788

[22] Filed: Apr. 5, 1989

Related U.S. Application Data

[63] Continuation of Ser. No. 113,382, Oct. 22, 1987, abandoned, which is a continuation of Ser. No. 777,377, Sep. 18, 1985, abandoned.

[30] Foreign Application Priority Data

| | | | |
|---|---|---|---|
| Sep. 27, 1984 | [JP] | Japan | 59-202228 |
| Sep. 27, 1984 | [JP] | Japan | 59-202229 |
| Sep. 27, 1984 | [JP] | Japan | 59-146086 |
| Dec. 19, 1984 | [JP] | Japan | 59-268990 |
| Dec. 19, 1984 | [JP] | Japan | 59-193304 |
| Jun. 19, 1985 | [JP] | Japan | 60-133795 |

[51] Int. Cl.[5] ..... B05D 1/08

[52] U.S. Cl. ..... 401/219; 101/120; 118/410; 118/415; 222/490; 401/261; 401/266

[58] Field of Search ..... 401/271, 285, 261–266, 401/219, 183, 186, 287, 219, 261; 101/120; 222/212, 213, 440, 494; 118/410, 411, 415

[56] References Cited

U.S. PATENT DOCUMENTS

| | | | |
|---|---|---|---|
| 399,927 | 3/1889 | Pomeroy | 401/264 |
| 1,065,610 | 6/1913 | Hooker | 401/288 |
| 1,494,315 | 5/1924 | Ostenberg | 118/415 |
| 1,936,368 | 11/1933 | Riebel, Jr. et al. | 401/266 |
| 1,988,557 | 1/1935 | Jecker | 401/271 |
| 2,049,973 | 8/1936 | Nesmith | 401/261 |
| 2,069,442 | 2/1937 | Heseltine | 401/263 |
| 2,135,237 | 11/1938 | Lewis et al. | 222/490 |
| 2,279,320 | 4/1942 | Huston | 401/186 |
| 2,314,383 | 3/1943 | Berners | 401/186 |
| 2,922,178 | 1/1960 | Kelly | 401/271 |
| 3,020,579 | 2/1962 | O'Connor | 118/410 X |
| 3,032,801 | 5/1962 | Alexander | 401/264 X |
| 3,120,677 | 2/1964 | Carpenter | 401/271 |
| 3,145,410 | 8/1964 | Stahl | 118/415 X |
| 3,231,145 | 1/1966 | Converse | 401/186 |
| 3,276,067 | 10/1966 | Boyle et al. | 401/186 |
| 3,334,792 | 8/1967 | DeVries et al. | 401/266 X |
| 3,375,056 | 3/1968 | Rosan | 401/186 |
| 3,384,438 | 5/1968 | Sherbondy | 401/264 X |
| 3,994,220 | 11/1976 | Vertegaal | 101/120 X |
| 4,085,672 | 4/1978 | Grosart | 101/120 X |
| 4,520,049 | 5/1985 | Nakanishi | 118/413 X |

FOREIGN PATENT DOCUMENTS

| | | | |
|---|---|---|---|
| 1092653 | 11/1954 | France | 401/219 |
| 1375754 | 9/1964 | France | 401/264 |

*Primary Examiner*—Steven A. Bratlie

*Attorney, Agent, or Firm*—Schweitzer Cornman & Gross

[57] ABSTRACT

An applicator for applying various kinds of paint, liquid adhesives and the like to a surface in such a way that they are spread evenly and uniformly on the surface. The applicator possesses a cylindrical member which has an applicating liquid reservoir formed in it and a conduit to carry the applicating liquid from the outside into the applicating liquid reservoir, and internally apply pressure on a resilient closure which maintains a slit normally closed, such internal pressure causes the slit to open along its entire length when the internal pressure of the applicating liquid in the applicating liquid reservoir is more than a predetermined level. The cylindrical member is designed in such a way that the slit opens equally along its entire length.

3 Claims, 8 Drawing Sheets

APPLICATOR

This is a continuing application of U.S. Ser. No. 113,382, filed on Oct. 22, 1987, which is a continuing application of U.S. Ser. No. 777,377, filed on Sept. 18, 1985, both now abandoned.

BACKGROUND OF THE INVENTION

The present invention relates to an applicator used for the application of various kinds of liquids, e.g. paint, liquid adhesive, and the like and more specifically to a roller for applying and spreading such liquids onto a desired surface. The invention also relates to a device with an applicator for applying paint to the wall face of a building, a steel-frame bridge, and the like.

Known roller systems for applying and spreading liquids have a rotatable application roller mounted to a pipe which introduces to the roller attached thereto the liquid to be applied. The pipe is connected to a liquid feeding pump. A plurality of effluent holes for the liquid to be applied are uniformly spaced around the pipe which is located at the inside of applicator roller. The liquid percolates out of these effluent holes from the internal surface side of the applicator roller to the outside. However, such a conventional applicator roller causes the liquid on the surface of the applicator roller to be gradient widthwise so that a non-uniform painting is easily incurred because the nearer the above-mentioned effluent hole is to the side where the liquid is introduced from the pipe, the more easily it flows because of higher pressure at those effluent holes. Furthermore, if the viscosity of the liquid to be applied is low, drops thereof come out in the vicinity of the above-mentioned introduction side, causing the surroundings become dirty. In this regard, if the feeding pressure of liquid is decreased to avoid such a situation, a blurred spreading takes place on the portion remote from the introduction side. For this reason, it is extremely difficult to adjust the discharge amount by a modification of the liquid feeding pressure. In addition to that, a problem is incurred when the feeding of the liquid is stopped because the liquid which remains in the inside of the applicator roller and in the introduction pipe drips out when the applicator roller is inclined.

SUMMARY OF THE INVENTION

The purpose of the present invention is to provide an applicator capable of uniformly applying liquids, e.g. paint, thus preventing nonuniform coatings of such liquids, e.g. paint, and blurred spreading.

Another purpose of the present invention is to provide an applicator which avoids a gradual dropping of the applied liquid which occurs when using conventional applicator rollers.

According to the applicator tool of the present invention, a slit opening is provided which is opened when the internal pressure of an inner liquid reservoir is more than a predetermined level, allowing the liquid to flow out by way of the slit opening upon the surface to be coated. The amount of the liquid flowing out becomes uniform along the lengthwise direction of the applicator tool, thus preventing a nonuniform, blurred coating, e.g. paint, and the coating e.g. paint, from dripping so that proper application results. A further advantage is that since feeding of the liquid is stopped by automatically closing the slit opening, there is no leakage to the outside of the liquid remaining in the reservoir.

The invention thus provides an applicator roller wherein the liquid to be supplied is first collected in the inner reservoir in a cylindrical member, and subsequently, when the internal pressure of the liquid in the reservoir is more than a predetermined level for causing a slit to open, the slit is opened causing the liquid to percolate by way of the slit opening to the applicator roller. The application process is performed resulting in a uniform coating and no dripping or blurring. The finish of the surface to which the liquid is applied becomes fine, the painter's work can be easily performed, any influence caused by a difference in viscosity of the liquid is minimized, and adjustment of the amount of the liquid to be applied which is discharged is facilitated. Further advantages are that when the supply of the liquid is stopped, the slit opening naturally closes due to a decrease in the internal pressure therein, the applicator roller is inclined, there is no leakage of liquid remaining in the cylindrical member or the liquid feeding pipe to the outside, thus, there is no apprehension that the dripping of the liquid may cause the surroundings to be dirty.

Other objects and advantages of the present invention will be apparent from the following description of the invention which proceeds in conjunction with the attached drawings:

DETAILED DESCRIPTION OF THE INVENTION

Figure 1:
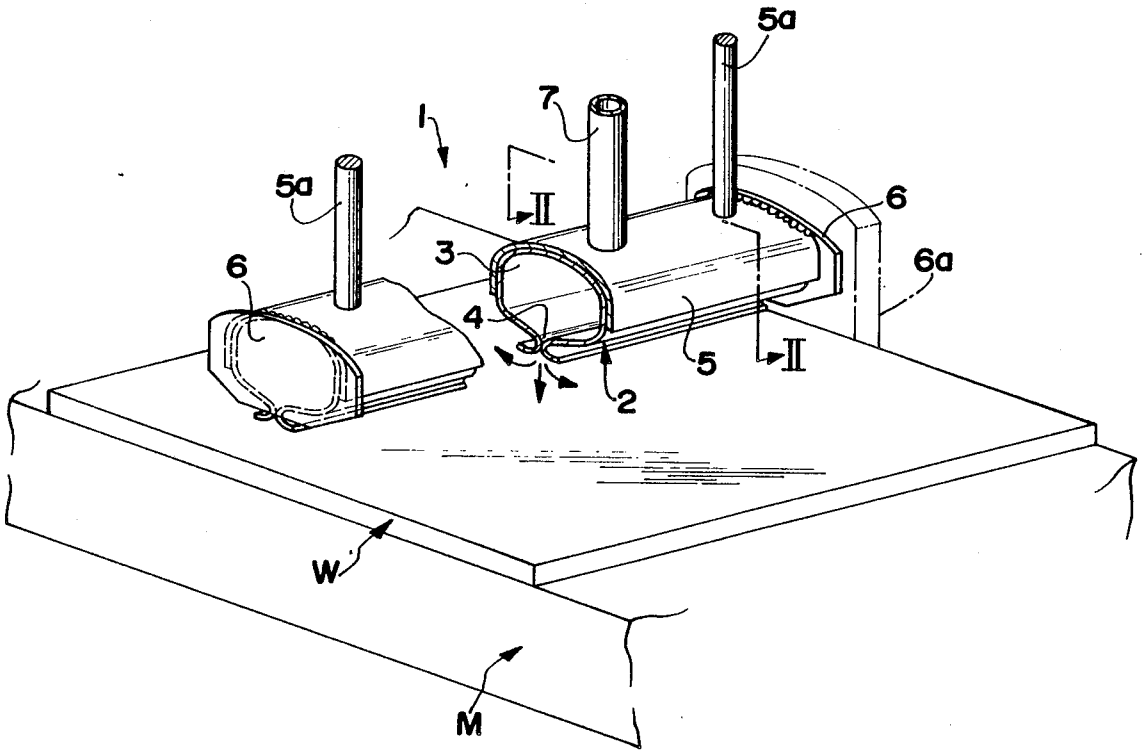
FIG. 1 is a partially cut-away perspective view of one embodiment of the applicator according to the present invention.
Figure 2:
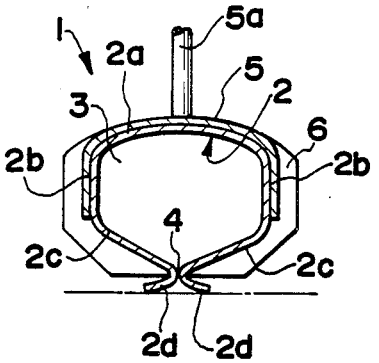
FIG. 2 is a sectional view taken on the line II—II of FIG. 1.
Figure 3:
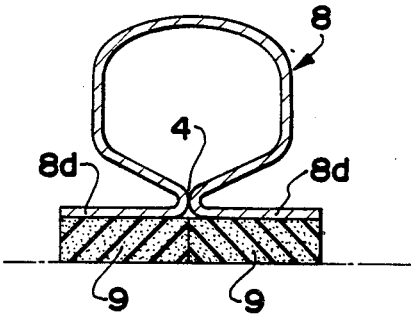
FIG. 3 is a sectional value of a modified example of the cylindrical article in the applicator of FIG. 1.

FIGS. 1 to 3 illustrate one embodiment of the present invention The applicator 1 has a cylindrical article 2 which comprises a bent metallic plate or an integrally molded synthetic resin. The generally cylindrical article 2 is of a cylindrical shape comprising an upper wall portion 2*a* of generally curved configuration extending the length of the cylindrical article 2, side wall portions 2*b* thereof extending downward from each side of the upper wall portion 2*a* and extending the length of the cylindrical article 2, lower wall portions 2*c* thereof which extend from the lower end of the side wall portions 2*b* the length of the cylindrical article and are inclined slightly toward the bottom side. They thrust against each other at the bottom portion of the lower wall 2*c* and about at folded-back edge portions 2*d* of said lower wall portions 2*c*. The folded back edge portions are folded back in directions opposite to each other such that each of the folded-back edge portions 2*d* describes a circular arc outward from the end part of the lower wall portions 2*c* forming a closed slit 4 which can be opened. Said upper wall 2*a*, side walls 2*b* and lower walls 2*c* together with the closed slit 4 forming a liquid reservoir 3 inside of the cylindrical article 2, and the slit 4 which is set to be open when the internal pressure from the liquid to be applied is more than a predetermined level, is formed between the abutted folded-back edge portions 2*d* of the lower wall portions 2*c* and extends along the full length of the cylindrical article 2. A reinforcing cover 5 possessing a length substantially identical to that of the cylindrical article 2 is formed of an elastic metallic plate of U-shaped section and is fitted on the upper wall portion 2*a* and both side wall portions 2*b* of the cylindrical article 2. It holds the slit 4 of the cylindrical article 2 closed. Side lids 6 which are in contact with each of the ends of the cylindrical article 2 and seal them are secured on each end of the reinforcing cover 5, at the upper wall portions thereof, e.g. by welding. The reinforcing cover 5 and the cylindrical article 2 are connected and fixed to the lower end of a holding rod 5*a* which is perpendicularly provided in a support groove so that the cylindrical article 2 and the reinforcing cover 5 are held under it so that the lower surfaces of the folded back edge portions 2*d* a a predetermined clearance from the surface of the plate W to which the liquid is to be applied. Instead of the holding rod 5*a*, one of the side lids can be connected and fixed to a holding frame which is fixed to an adequate base bench. A liquid feed pipe 7 is a means of supplying the liquid to be applied. The top end portion of the feed pipe 7 is mounted to penetrate the reinforcing cover 5 and the cylindrical article 2 so that the liquid which is pressurized to be fed by a pressure type of feeding pump, may be into the liquid reservoir 3 in the cylindrical article 2. The above-mentioned plate W which is put on a moving bench M such as a conveyer, is adapted to be transferred horizontally in the direction of the arrow of FIG. 1.

Accordingly, when using the foregoing applicator 1, the pressurized liquid is collected from the liquid feeding pipe 7 into the liquid reservoir 3 in the cylindrical article 2. Upon an increase of the internal pressure in the liquid reservoir 3 beyond a predetermined level, the side wall portions 2*b* and the lower wall portions 2*c* of the cylindrical article 2 are elastically deformed outward together with the corresponding section of the reinforcing cover 5, whereby the slit 4, facing to the surface to which the liquid is to be applied, is uniformly opened along its lengthwise direction, the liquid comes out to the surface and, at the same time of opening the slit 4, the plate W to which the liquid is to be applied starts to move so that a coating of a predetermined thickness is formed on the plate W. The lower faces of folded-back edge portions 2*d* of the cylindrical article 2 act as a levelling means of the coated surface through their stroking thereof. Cessation of feeding of the liquid causes a decrease of the internal pressure in the liquid reservoir 3 which automatically causes the open slit 4 to close thereby stopping the effluent flow of the liquid.

FIG. 3, illustrates a modified example of a cylindrical article in the applicator 1. It shows folded-back edge portions 3*d* of the cylindrical article 8 which extend horizontally for a longer distance than folded-back edge portions 2*d* of FIG. 2. They extend in directions opposite to each other and sponge pads 9 of diamond-shaped section are secured under each lower face of these folded-back edge portions 8. For this reason, when the liquid is discharged from the open slit 4 the pads 9 are impregnated with the liquid, which is adapted to be painted from the lower face side of the pads 9 to the surface to be coated.

Figure 4:
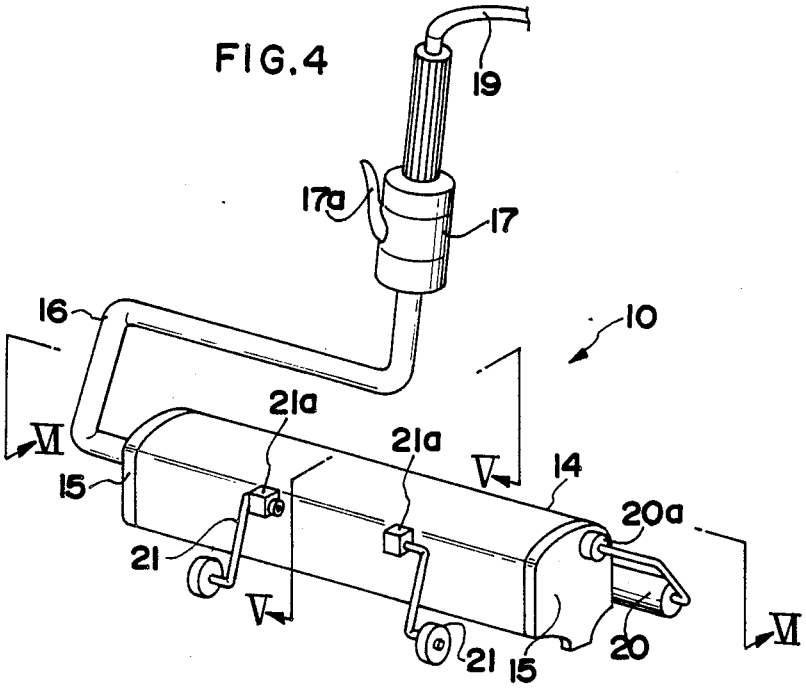
FIG. 4 is a perspective view of the applicator of another embodiment according to the present invention.
Figure 5:
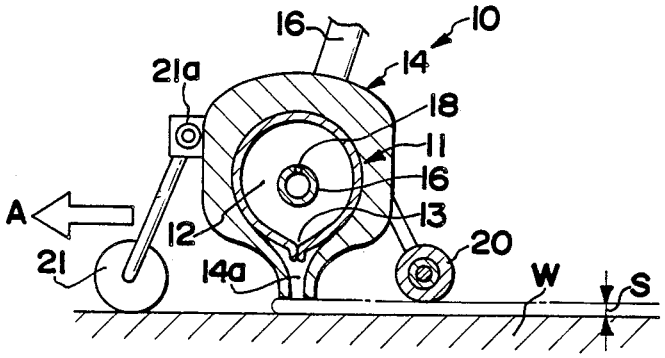
FIG. 5 is a sectional view taken on the line V—V of FIG. 4.
Figure 6:
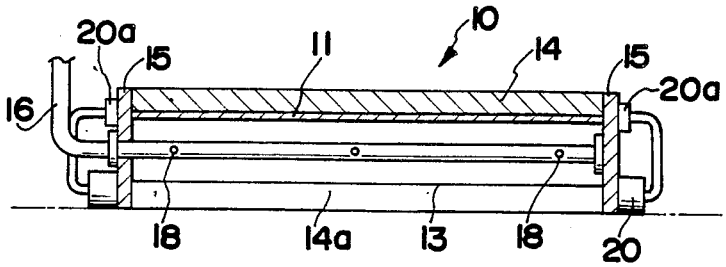
FIG. 6 is a sectional view taken on line VI—VI of FIG. 4.

FIGS. 4 to 6 illustrate an applicator 10 of another embodiment according to the present invention. The cylindrical article 11 which possesses a reservoir 12 therein for the liquid being applied and a slit 13 on the bottom thereof, is fitted into a body 14 having an opened groove 14*a* on the bottom thereof below the slit 13. A pipe 16 with holes 18 is inserted axially into the cylindrical article 11 and is fixed to end plates 15 of body 14, and is bent upwards on the outside of the body 14 at one end thereof, the top portion of the pipe 16 beyond the bend outside of the body 14 is equipped with a handle 17 having a lever 17*a* and a liquid feeding tube 19. A guide roller 20, longer than a body 14, and two guide discs 21 are each mounted to the body 14. The position of the roller 20 and the guide discs 21 can be adjusted by adjusting tools 20*a* and 21*a* mounted thereon. In operation of the applicator 10, one transfers the applicator 10 onto the plate W to which a liquid is to be applied and grasps the handle 17, squeezing the lever 17*a* thus causing the liquid to come out from the slit 13 whereupon it is discharged from the opened groove 14*a*, thereby forming a coated film of uniform thickness S. The thickness S of the coated film can be adjusted by the position of the guide roller 20 and the guide discs 21, and, if the peripheral face of the guide roller 20 is provided with notched pattern, it enables an ornamental pattern to be formed on the surface W to which it is applied.

Figure 7:
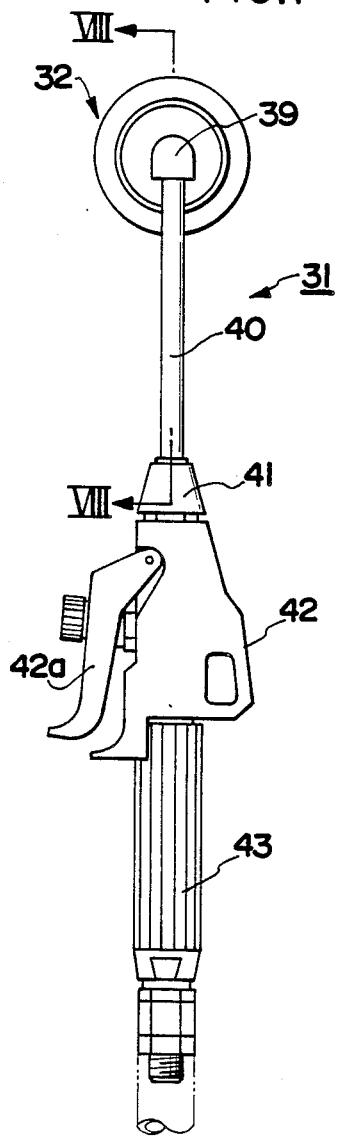
FIG. 7 is a side view of the applicator roller of yet another embodiment according to the present invention.
Figure 8:
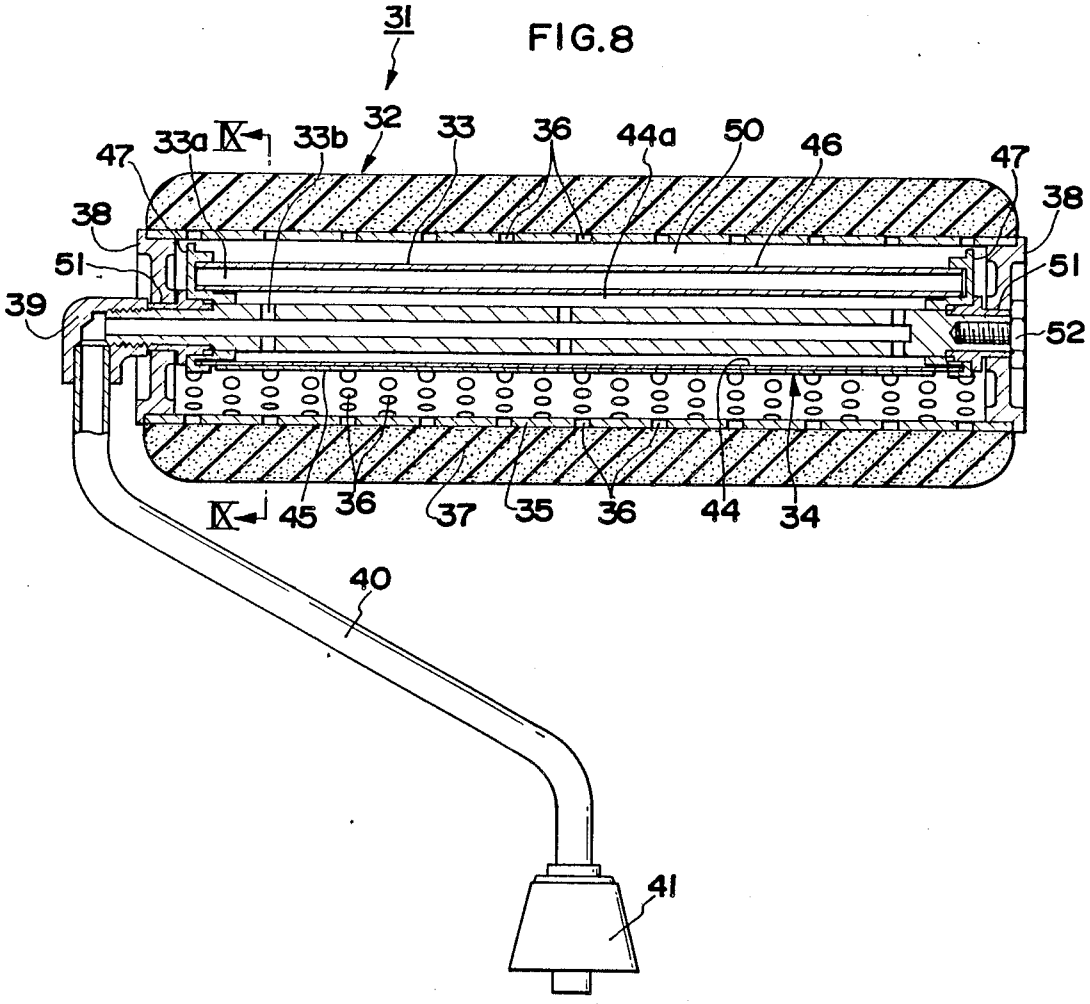
FIG. 8 is a sectional view taken on the line VIII—VIII of FIG. 7.
Figure 9:
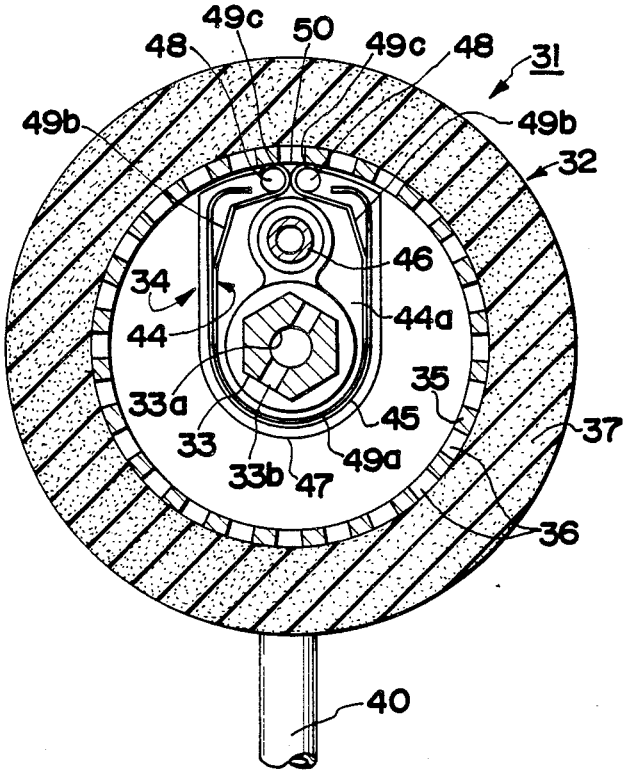
FIG. 9 is a sectional view taken on the line IX—IX of FIG. 8.

FIGS. 7 to 9 illustrate another embodiment of the present invention. An applicator 31 is constructed such that an applicator roller 32 is rotatably supported by a roller shaft 33 therein. A discharging unit 34 from which the liquid to be applied is discharged through a slit opening when the internal pressure reaches a predetermined level is fixedly mounted to the roller shaft 33 in the application roller 32. The application roller 32 comprises of internal cylinder 35 on the full peripheral face of which a number of holes 36 are provided. An impregnating roll portion 37, made of flocked fabric, woven fabric, nonwoven fabric, sponge and the like, is secured to the outer peripheral face of the support cylinder 35, and to end plates 38 which are mounted to both ends of the support cylinder 35. Each end part of the roller shaft 33 is round in shape, an axially intermediate portion thereof is hexagonal in shape. The hexagonal part is inserted into the discharging unit 34, so the discharging unit 34 is not able to be rotated. The round-shaped part of the roller shaft 33 rotatably supports the end plates 38 of the application roller 32 with collars 51. One end of the roller shaft 33 is connected by a coupling band 39 to a supporting arm 40 which also serves the function of feeding to the applicator 31 the liquid to be applied. The supporting arm 40 is equipped with an adapter 41 on a portion remote from the applicator 31, a lever 42*a* for opening and closing a valve 42 which parts are further up the supporting arm 40 than the adaptor 41 and a handle 43. At the top end of the handle 43 is a hose, through which the liquid to be applied is fed by means of a pressure pump.

The discharging unit 34 is formed of a generally cylindrical member 44, a supporter 45, a pipe rod 46, and end plates 47.

The cylindrical member 44, which is made of an elastic, thin metallic plate which is bent and subsequently winds core metals comprising elastic metallic wire in its end part, is formed into a cylindrical shape comprising the side wall portion 49*a*, bent portions 49*b*, and marginal portions 49*c*. The supporter 45 encircling the cylindrical member 44, which is made of metallic plate, has its internal shape formed smaller than the external shape of the cylindrical member 44 which is correspondingly under the free state, whereby both the marginal portions 49*c* are elastically in contact with each other so that the slit 50 may be closed. Furthermore, the marginal portions 49*c* are adapted to get almost in a slidable touch with the internal peripheral face of the support cylinder 35, and, when the pressure of the liquid in the reservoir 44*a* in the cylindrical member 44 is increased, the bent portions 49*b* are elastically deformed, thereby opening the slit 50. The coupling part of the cylindrical member 44 and the supporter 45 with the end plates 47 is in the closed state secured by adhesive so that the liquid contained therein will not leak. The roller shaft 33 penetrates a hole which has a form identical to that of the hexagonal part of the roller shaft 33 and is provided on each of its ends with end plates 47, which support the end plates 38 with collars, so that bolts 52 prevent the end plates 38 from coming out. The roller shaft 33 has an axial 33*a* and radial holes 33*b* from which the liquid to be applied is pressurized so it is fed from the foregoing hose through the valve 42, the supporting arm 40 and the coupling band 39, and flows into the liquid reservoir 44*a*. When the pressure of the liquid in the reservoir 44*a* is more than a predetermined level, the marginal portions 49*c* are forced to be expanded against the elastic force of the bent portions 49*b*, whereby the slit 50 is opened along its full length so that the liquid is fully discharged axially. Then, the marginal portions 49*c* cause the liquid to be pressed to the internal peripheral face of the support cylinder 35 and further to percolate uniformly through the holes 36 into the impregnating roll portion 37. The pipe rod 46 not only fulfills the purpose of reinforcing the discharging unit 34 but also minimizes a dead space in the liquid reservoir 44*a*.

The applicator 31 is operated by grasping the handle 43 and pressing the lever 42*a* which permits the application roller 32 to be uniformly and axially impregnated with the liquid to be applicated by means of an action of the discharging unit 34. For this reason, transferring the handle 43 and rotatively moving the application roller 32 on a plate to which the liquid is applied attains a uniform coating and do not rise to any non-uniformity of the applied coating. An adjustment of the pressure of the liquid which is supplied to the applicator 31 enables the discharge amount from the discharging unit 34 to be adjusted and to be axially uniform. There is thus no apprehension that blurred spreading and a gradual drop of the liquid, will result since a comprehensive adjustment of the discharge amount can easily be made. When the lever 42*a* is released it stops the supply of the liquid. The decrease in the internal pressure of the liquid reservoir 44*a* may be automated to close the slit 50, so that even inclining of the applicator 31 does not cause the liquid in the applicating liquid reservoir 44*a* and the supporting arm 40 to come out. There is no need for concern that any gradual drop of the liquid will make the surrounding area dirty.

Referring to the foregoing discharging unit 34, it may be acceptable to omit the supporter 45, which has been provided in order to reinforce the cylindrical member 44, if the strength of the cylindrical member 44 is selected with the proper material quality and thickness. In that case, there is a large choice of suitable, materials, thus member 44 can be formed of a metallic plate whose elastic modulus is relatively large and the thickness thereof can be such that selection of a synthetic resin which meets the requirements for obtaining sufficient elastic modulus can be readily done. Also, the bent portions 49*b* and the marginal portions 49*c*, the material quality of which is different from that of other parts, can be integrally shaped. Furthermore, the sectional shape of the cylindrical member 44, which is not limited to that in the above-mentioned embodiment, may have a large range of optional dimensions since it is subject to the design wherein a predetermined level of the internal pressure causes the slit 50 to be elastically opened. Furthermore, the length of the cylindrical member 44 and the slit 50 may constitute axial and partial sections of the applicator 31. In the case where liquid to be applied has a high velocity, it is also acceptable that the clearance between the folded-back end portions 49*c* of circular arc and the support cylinder 35 is enlarged and that the slit 50 is formed to be slightly opened under the natural state.

Figure 10:
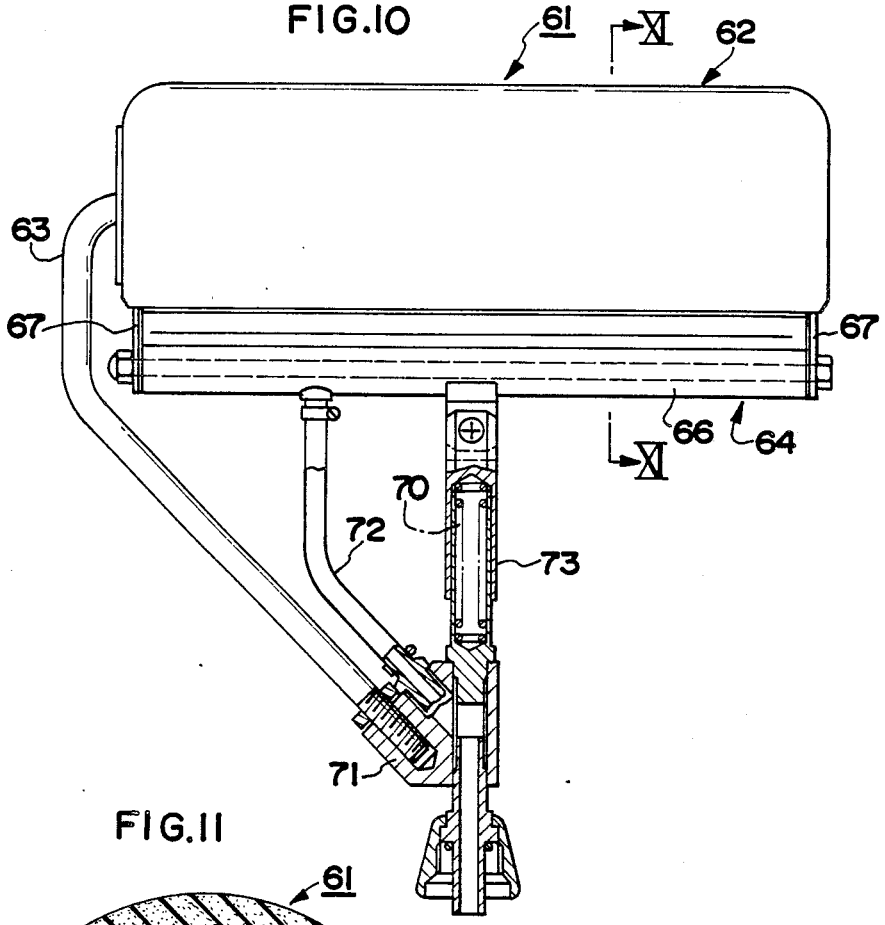
FIG. 10 is a plan view of the applicator roller of still another embodiment according to the present invention.
Figure 11:
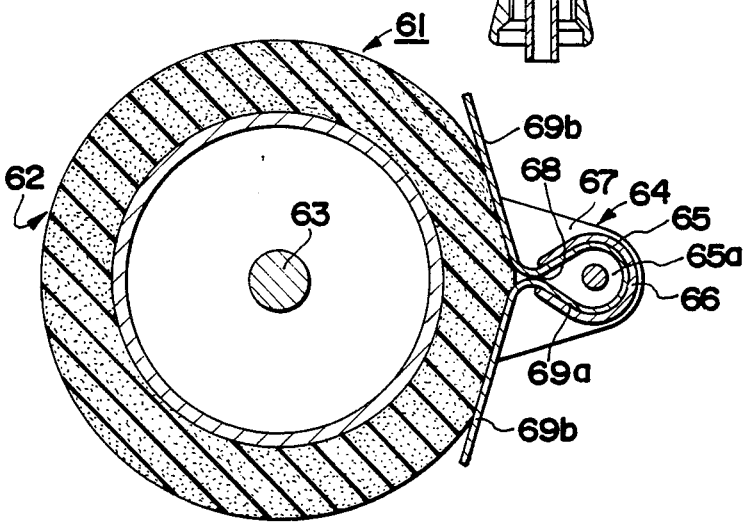
FIG. 11 is a sectional view taken on the line XI—XI of FIG. 10.

FIGS. 10-11 illustrate another embodiment of the present invention. The applicator 61 is constructed of the applicator roller 62 which is rotatably supported by the roller shaft 63 and the discharging unit 64 which paints axially the liquid which is applied on the external peripheral surface of the application roller 62. The discharging unit 64 comprises the cylindrical member 65, the supporter 66, and the end plates 67. The cylindrical member 65 is equipped with a slit 68 which is opened when the pressure in the applicating liquid reservoir 65*a* is increased. This cause the wide marginal portions 69*b* to be pressed against the application roller 62 by means of a coil spring 70. The hose 72 for introducing the application roller 62 by means of a coil spring 70. The hose 72 for introducing the applicating liquid, an expandable and shrinkable shaft 73 for supporting the discharging unit 64, and the adaptor 74 for mounting the hose and the handle which supply the liquid to be applied are mounted to a mounting base 71 which is mounted on the end of the roller shaft 63. According to the applicator 61, an action of the discharging unit 64 impregnate uniformly the application roller 62 with the liquid without an occurrence of non-uniform and blurred spreading. Dripping of the liquid does not occur. Attaching the discharging unit 64 to a conventional applicating roller makes it easier to construct the applicator 61 of this invention.

Figure 12:
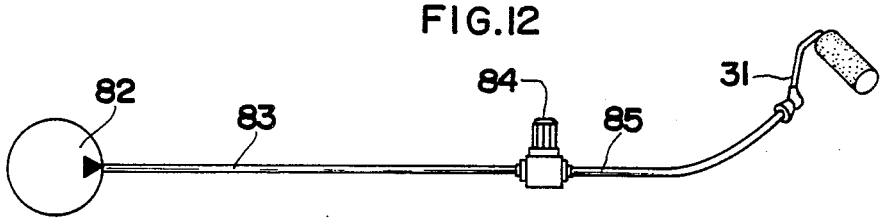
FIG. 12 is a view showing supplying the liquid to be supplied to the applicator roller.
Figure 13:
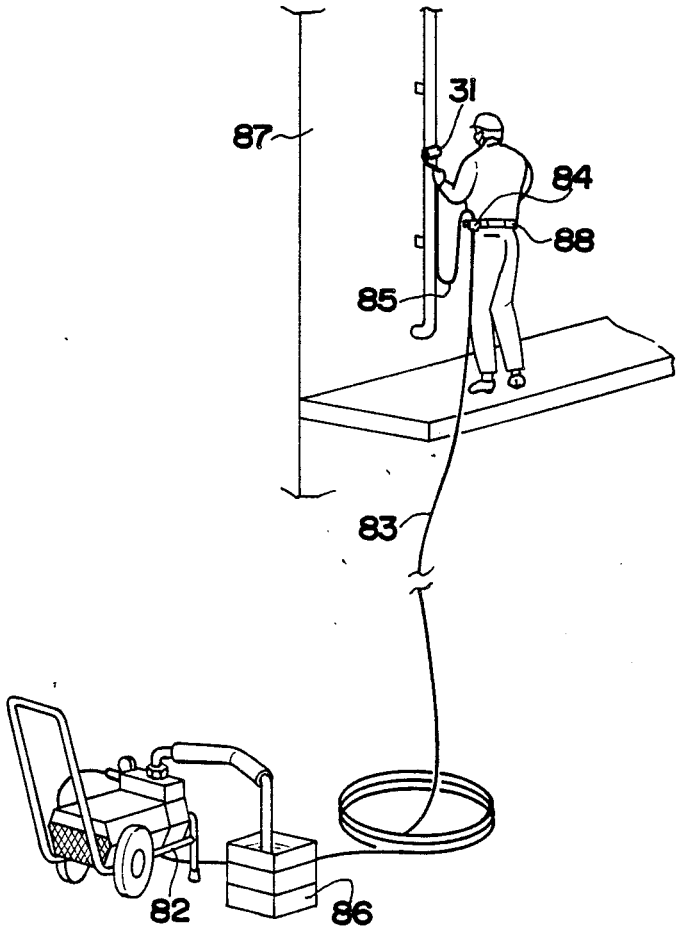
FIG. 13 is a view showing the use of the arrangement of FIG. 12.

FIGS. 12-13 illustrate an applicating device 81 which applies paint by using the applicators 31 and 61. The applicating device 81 comprises a pressure type of feeding pump 82 which feeds the paint, while pressurizing it to a higher pressure; a high-pressure hose 83 of high-pressure resistance and comparatively long, which is coupled to the pressure type of feeding pump 82, a reduction valve 84 the primary side of which is coupled with the top end of the high-pressure hose 83; a low-pressure hose 85, soft and relatively short which is coupled with the secondary side of a reduction valve 84; and the applicator 31, coupled with the top end of the low-pressure hose 85, which does the applying on the surface to be applied. The high-pressure hose 83 is usually ten meters or more in length, the lower-pressure hose 85 is about 1–2 meters long, and the reduction valve 84 adjusts variably the high-pressure of 100–200 $kg/cm^2$ to the low-pressure of less than abt. 35 $kg/cm^2$. Referring to FIG. 13, the pump 82 is put on the ground together with an applicating tank 86, and the operator who performs the painter's work on higher places has the reduction valve 84 hung to a waist band 88 by means of adequate sling tool such as ring, a hook and the like. Since such an arrangement causes paint of higher pressure to be fed in the high-pressure hose 83 irrespective of the viscosity and specific gravity of the paint, thus it is possible to feed the paint higher places, covering a long distance, and a connection only of the soft low-pressure hose 85 to the applicator 31 may enable the operator to do work easily, making an advancement in the work efficiency. In order to make further improvements in safety for the operator. It meets the requirements by hanging the reduction valve 84 to an adequate place of the building, the hanging place of the reduction valve 84 being changed in response to the mode of transferring the place to be applied. It is possible to use various kinds of applicators such as a flange and the like as the constituent parts of the applicator 31.

What is claimed is:

1. An applicator for dispensing a liquid, comprising an elongated reservoir having an annular cross-section, and having on the surface thereof a flexible reinforcing cover of a length substantially identical to that of the elongated reservoir, said reservoir having lids fitted over and sealing the ends of said elongated reservoir, said reservoir being formed to define a slit having folded back edges, said slit running longitudinally along the length of said reservoir for selectively releasing liquid from said reservoir, resilient means for maintaining said slit normally closed, and pressuring means for increasing the pressure of the liquid on said resilient means for opening said slit along its length for releasing liquid from said reservoir.

2. The applicator of claim 1, further comprising an applicator member for the liquid.

3. The applicator of claim 2, wherein said applicator member is an applicator roller.

* * * * *